US006106024A

United States Patent [19]

Herman et al.

[11] Patent Number: 6,106,024

[45] Date of Patent: Aug. 22, 2000

[54] RISER JOINT AND APPARATUS FOR ITS ASSEMBLY

[75] Inventors: Richard J. Herman, Houston; Micheal D. Floyd, Conroe, both of Tex.

[73] Assignee: Cooper Cameron Corporation, Houston, Tex.

[21] Appl. No.: 09/090,868

[22] Filed: Jun. 4, 1998

[51] Int. Cl.[7] ..... F16L 35/00

[52] U.S. Cl. ..... 285/18; 285/333

[58] Field of Search ..... 285/18, 24, 40, 285/115, 360, 333, 376, 355, 401

[56] References Cited

U.S. PATENT DOCUMENTS

| | | | |
|---|---|---|---|
| 1,682,187 | 8/1928 | Saunders | 285/376 |
| 3,189,372 | 6/1965 | Johnson . | |
| 3,508,609 | 4/1970 | Fowler et al. . | |
| 3,923,324 | 12/1975 | Cruickshank et al. | 285/18 X |
| 3,948,545 | 4/1976 | Bonds . | |
| 4,012,059 | 3/1977 | Luke et al. . | |
| 4,062,571 | 12/1977 | Sicard . | |
| 4,124,231 | 11/1978 | Ahlstone | 285/18 |
| 4,146,082 | 3/1979 | Granger | 285/18 X |
| 4,185,856 | 1/1980 | McCaskill . | |
| 4,436,325 | 3/1984 | Miller . | |
| 4,645,247 | 2/1987 | Ward . | |
| 4,648,627 | 3/1987 | Reimert | 285/24 |
| 4,696,494 | 9/1987 | Schmitz et al. . | |
| 4,844,511 | 7/1989 | Galle et al. . | |
| 4,902,046 | 2/1990 | Maloberti . | |
| 5,098,132 | 3/1992 | Burton . | |
| 5,141,257 | 8/1992 | Taylor . | |
| 5,160,172 | 11/1992 | Gariepy | 285/355 X |
| 5,404,832 | 4/1995 | Hart . | |

FOREIGN PATENT DOCUMENTS

| | | |
|---|---|---|
| 0102919 | 3/1984 | European Pat. Off. . |
| 903757 | 8/1962 | United Kingdom . |
| 2064041 | 6/1981 | United Kingdom . |

*Primary Examiner*—Lynne H. Browne
*Assistant Examiner*—Greg Binda
*Attorney, Agent, or Firm*—Duane, Morris & Hecscher

[57] ABSTRACT

A joint design particularly useful in subsea risers is disclosed. The joint is preferably of a pin and box design where one of the components is held in a stressed condition as the joint is made up and locked together. A portion of the applied stress is then removed, leaving a preload in the assembled joint. A hydraulically operated tool is used to apply the stress while at the same time supporting the riser string. The joint can seal with resilient seals or metal-to-metal contact, or both. The locking device can be of a variety of types including but not limited to breech lock, threads, or lock rings. The pin and box may be made of different materials that have different yield strengths and moduli of elasticity.

21 Claims, 10 Drawing Sheets

RISER JOINT AND APPARATUS FOR ITS ASSEMBLY

FIELD OF THE INVENTION

The field of this invention relates to equipment and techniques for assembling joints in subsea risers, particularly where strains are to be built-in to the assembled joint.

BACKGROUND OF THE INVENTION

When joints of pipe are subjected to a combination of tension loads and oscillatory bending loads, such loadings can cause stress reversals which, in turn, can cause the connection to fail. Such loadings are a particular issue when pipe joints are connected as part of a riser pipe extending vertically between a wellhead, x-mas tree, and an offshore location and a tensioning device or supporting device aboard a drilling vessel from which operations could be conducted. The riser pipe, which can extend to a length of several thousand feet, is not only subjected to tension loads as the vessel rises and falls on the water level, but also to bending loads due to the water currents. To deal with such situations, a pipe connector has been proposed in U.S. Pat. No. 4,012,059 where a part of the joint is stretched to preload it while the preload is held by rotation of a nut to make-up any slack caused by the tensioning of a portion of the joint. Some of the disadvantages of this technique are that each joint has to be specially designed and that the nut has to be rotated with appropriate power tools for each joint to hold the desired tension. Thus, a large nut must be operated with a wrench while the two components of the joint are pushed together and the pin is under a tensile stress. The nut is mounted to the box and is rotated with a wrench until it engages the pin. The joint construction is complicated, making each joint expensive to manufacture such that the entire riser string which contains numerous joints winds up being a substantial investment for the well operator. Additionally, there are hazards involved in operation of the nut while one component of the joint is subjected to stresses. Finally, the amount of residual strain in the joint is variable because it is a function of the final position of the nut which is turned while the pin is under a stress loading.

Other patents that illustrate generally different kinds of joints used in subsea risers are seen in the following U.S. Pat. Nos.: 3,189,372; 3,508,609; 4,185,856; 4,062,571; 5,404,832; 4,844,511; 4,436,325; 4,696,494; 4,902,046; 5,141,257; 5,098,132; and 3,948,545, which illustrates a breech lock type of a connection.

What has been missing in the prior art described above is a joint of simple construction that can lend itself to rapid deployment while at the same time being of a low-cost design. The joint can be assembled quickly to provide a positive preload riser connection which has a robust design with enhanced fatigue-resistant operation in a wide variety of water depths, environmental conditions, and riser lengths. One of the objectives of the invention is to provide a riser connector and deployment system which can be used with drilling, workover, completion, intervention, or production operations for conventional vessel riser supporting techniques or self-supporting freestanding buoyant riser applications. Another objective of the invention is to provide equipment which will facilitate the rapid make-up and/or release of each joint. Yet another objective is to provide a high-strength joint that will provide the performance capability of oilfield premium joints. Another objective is to be able to provide a joint which can be made-up quickly and disassembled quickly and safely. Simplicity of the design and strength and performance are also objectives of the joint in question. Those and other objectives will be evident from a review of the preferred embodiment of the invention described below.

SUMMARY OF THE INVENTION

A joint design particularly useful in subsea risers is disclosed. The joint is preferably of a pin and box design where one of the components is held in a strained condition as the joint is made up and locked together. A portion of the applied strain is then removed, leaving a preload in the assembled joint. A hydraulically operated tool is used to apply the strain while at the same time supporting the riser string. The joint can seal with resilient seals or metal-to-metal contact seals, or both. The locking device can be of a variety of types including but not limited to breech lock, threads, or lock rings. The pin and box may be made of different materials that have different yield strengths and moduli of elasticity.

DETAILED DESCRIPTION OF THE PREFERRED EMBODIMENT

Figure 9:
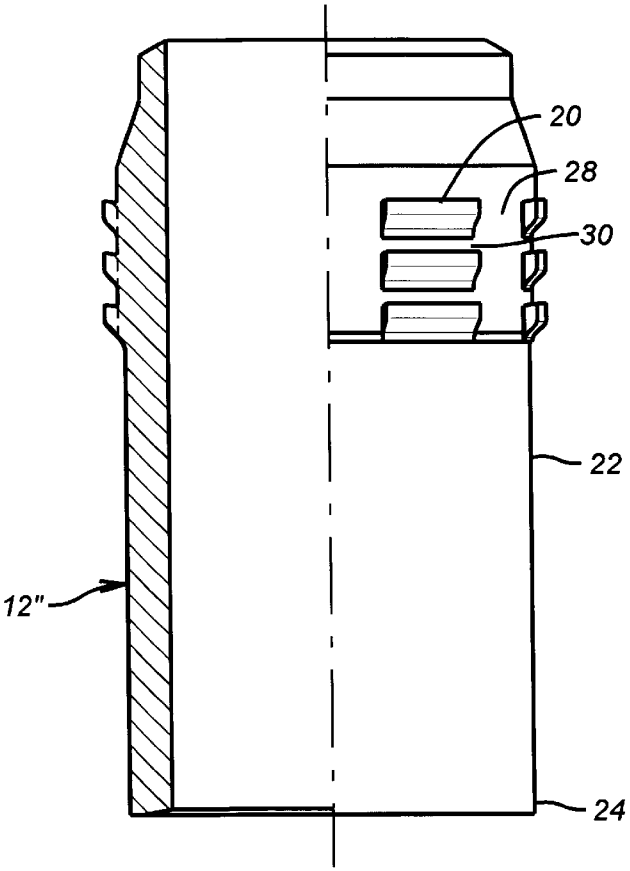
FIG. 9 is a sectional elevational view in part section, showing the pin end of the connection.
Figure 7:
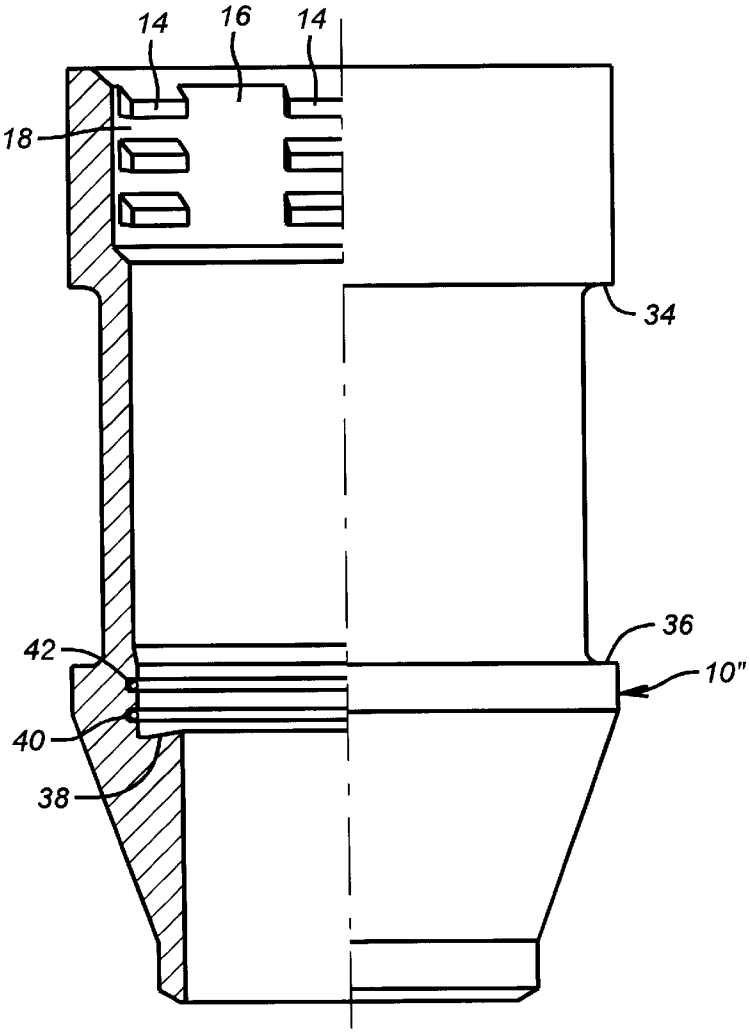
FIG. 7 is an elevational view, part cut away to show the box end of the connection.
Figure 10:
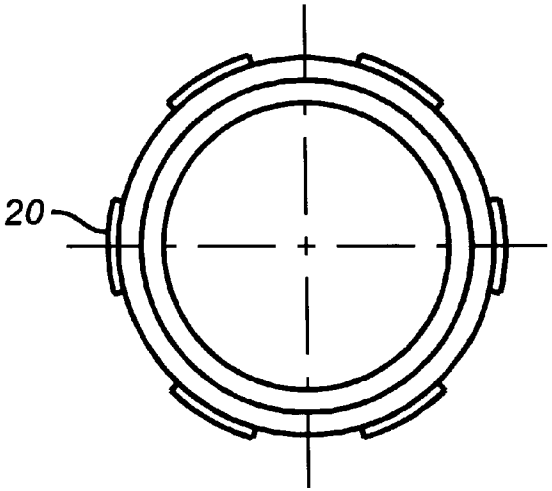
FIG. 10 is an end view of FIG. 9.
Figure 8:
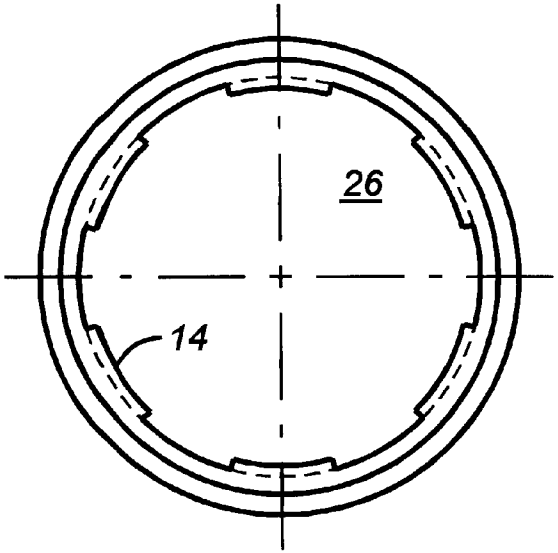
FIG. 8 is an end view of FIG. 7.

The joint of the present invention is preferably made of a box end 10 and a pin end 12. In a breech lock style for the present invention shown in FIGS. 7 and 9, the box 10" has circumferentially spaced projections 14, separated by circumferential spaces 16 such that in the design depicted in FIG. 7, there are three separate projections 14 above each other to form rows of projections 14, each separated by an axial space 18. As shown in FIG. 7, the projections 14 are radial projections. The pin 12" has projections 20 which are circumferentially distributed on its outer surface 22. The pin 12" has a lower end 24 which is insertable into opening 26 at the top of the box 10 (see FIG. 8). The projections 20 on the pin 12" have circumferential spaces 28 and axial spaces 30 such that, as shown in FIG. 9, there are shown a stack of three projections 20 which form discrete rows of projections 20.

Figure 1:
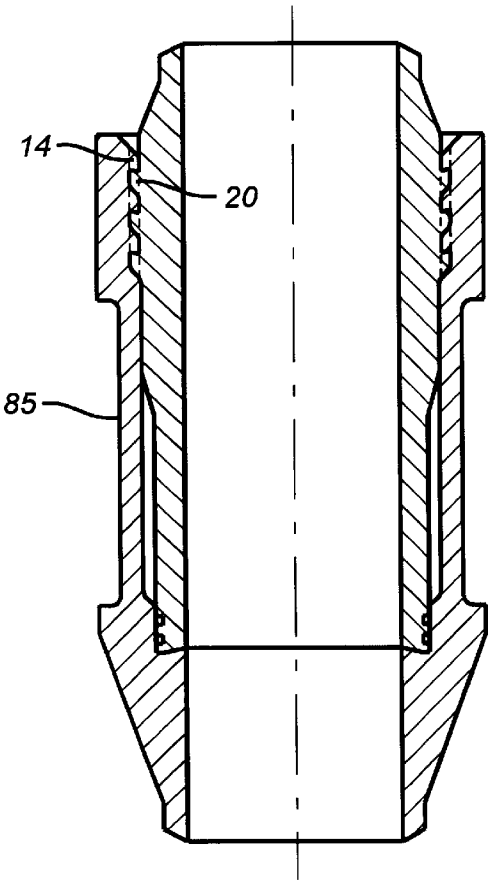
FIG. 1 is a sectional elevational view of the connector of the present invention, using a preload on the box and a compressive preload on the pin with a breech lock.
Figure 12:
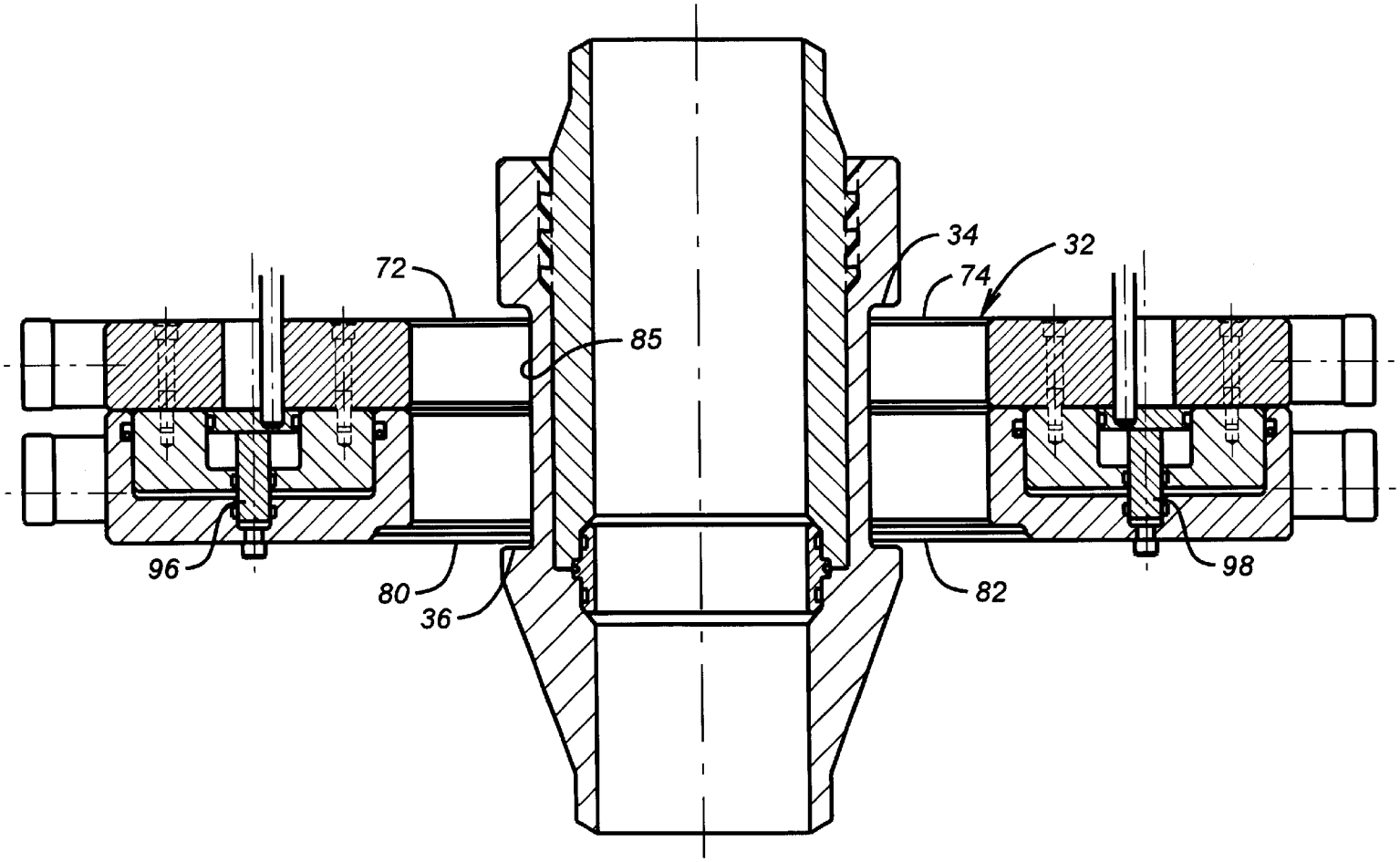
FIG. 12 is a spider which can be used to apply a tensile preload.
Figure 13:
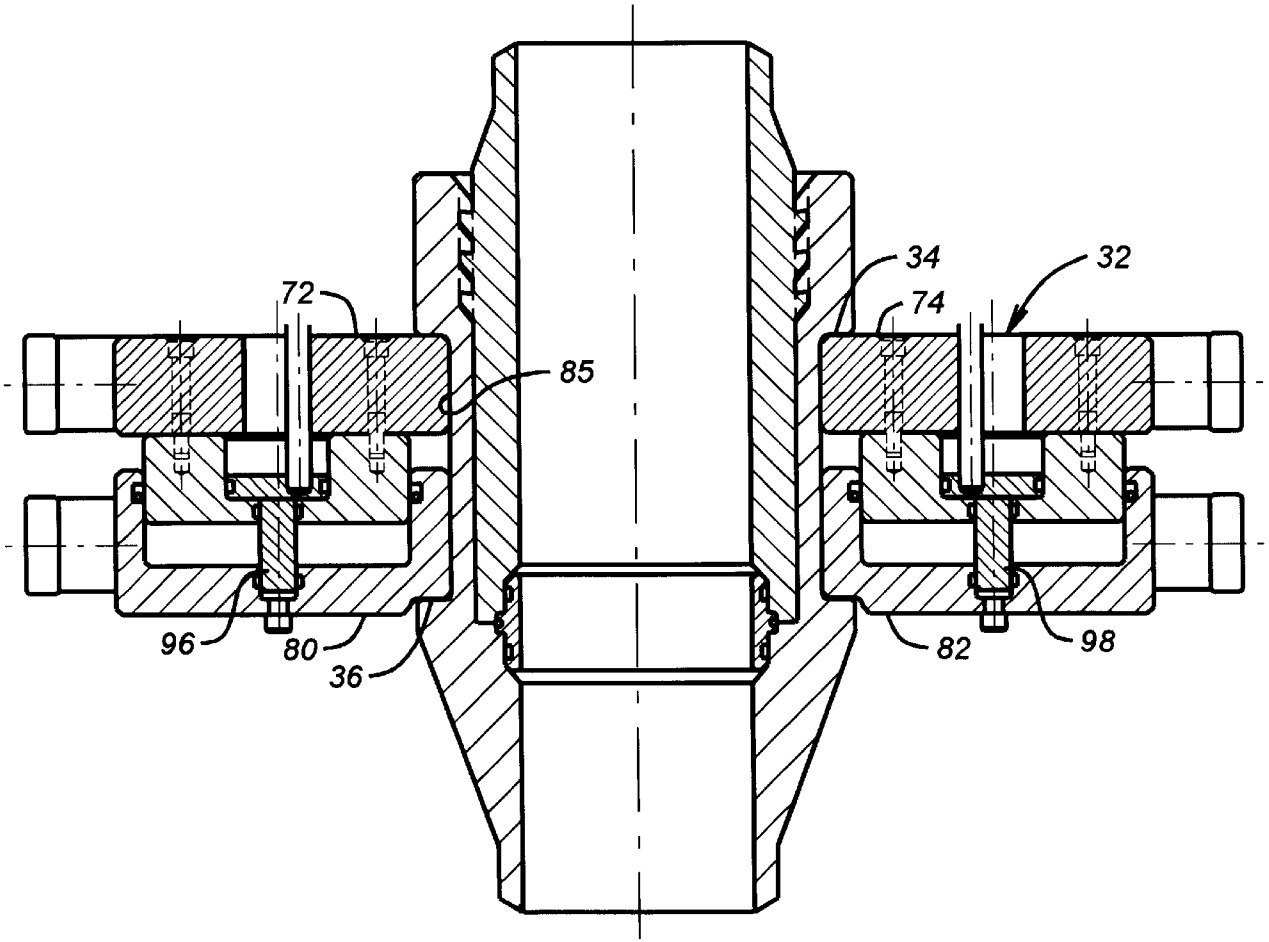
FIG. 13 is the view of FIG. 12 with the spider in the expanded condition, creating a tensile load in the box.

To make up the joint illustrated in FIGS. 7–10, the box 10" is preferably stretched with a spider 32 (see FIGS. 12 and 13). The detailed workings of the spider 32 will be described later. It suffices at this time to say that the spider exerts equal and opposite forces on shoulders 34 and 36 so as to put the box in tension. Internally, the box 10" has a reverse shoulder 38. Adjacent to reverse shoulder 38 are a pair of O-ring seals 40 and 42. Lower end 24 of the pin 12" ultimately is inserted into the opening 26 with the spider 32 supporting the weight of the box 10" and the associated segments of the riser already previously assembled. It should be noted that the use of the spider 32 increases the distance between shoulder 38 and the rows of projections 14 as the box 10" is elastically strained. While the spider 32 holds the box 10" under a tensile strain, full insertion of the pin 12" into the box 10" allows lower end 24 to shoulder on shoulder 38, as shown in FIG. 1. A rotational force applied to the pin 12" puts the projections 20 within the spaces 18 and allows spaces 30 on the pin to straddle the projections 14 on the box 10". The amount of relative rotation necessary to lock the joint with an applied tensile stress varies with the configuration of the projections 14 and 20 and the various spaces 16 and 28 circumferentially between adjacent projections 14 and 20.

In the preferred embodiment, relative rotation of about 30° is sufficient to lock the joint. This condition is attained when the projections 20 are fully aligned with projections 14 in spaces 18. This is shown more clearly in FIG. 1. When the pin 12" is locked to the box 10", the spider 32 is actuated to allow the box 10" to contract. When that occurs, the projections 14 move relatively to the projections 20 whose position is fixed due to the shouldering of lower end 24 on shoulder 38. There are, of course, gaps axially such that the spaces 18 are wider than the axial dimension of projections 20 to allow the necessary relative rotation to lock the joint. However, it is one facet of the present invention that the box 10" is not allowed to contract to its original dimension which was at the time prior to application of the tensile force with the spider 32. Instead, a residual stress is built into the joint as the projections 14 bear down on the projections 20 and push the lower end 24 into shoulder 38. By building in the residual strains into the projections 14 and 20, the joint remains locked and does not become undone due to the applied loads from such things as wave action, currents, and other cyclical loads which are experienced by the riser (not shown) of which the joint is but a component part. Those skilled in the art will appreciate that the riser (not shown) comprises of a series of pipe segments connected to each other by a joint such as illustrated in FIGS. 7–10.

Figure 16:
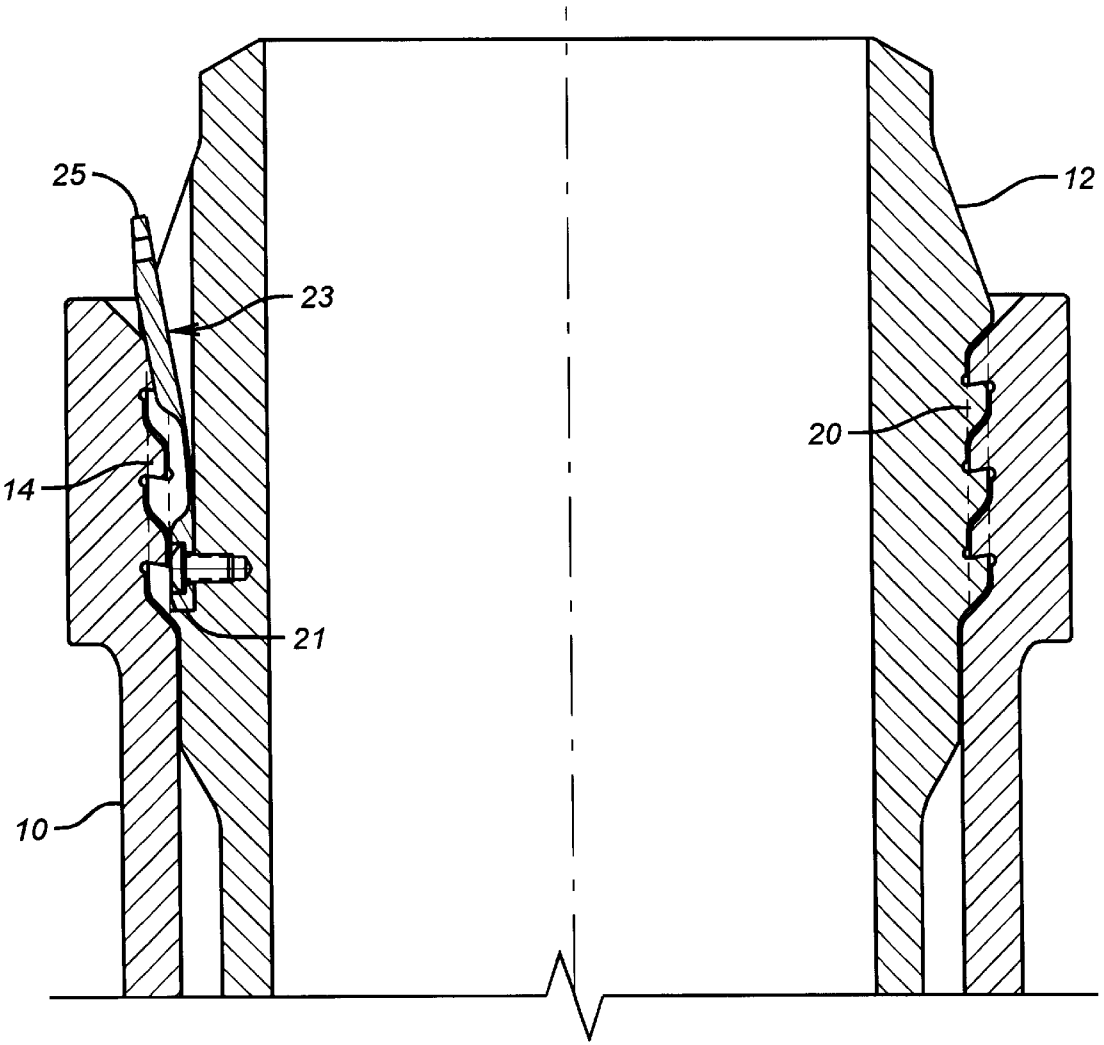
FIG. 16 shows a safety locking device to be used with the breech lock design of FIG. 1.

A safety feature to prevent reverse rotation is illustrated in FIG. 16. On the pin 12" between projections 20 and in a recess 21 a flexible tab 23 is mounted. The projections 14 on box 10 push back end 25 of tab 23 and after relative rotation end 25 pops out between projections 14 to prevent reverse rotation. To release end 25 is pushed back prior to straining box 10 and rotating pin 12.

Figure 11:
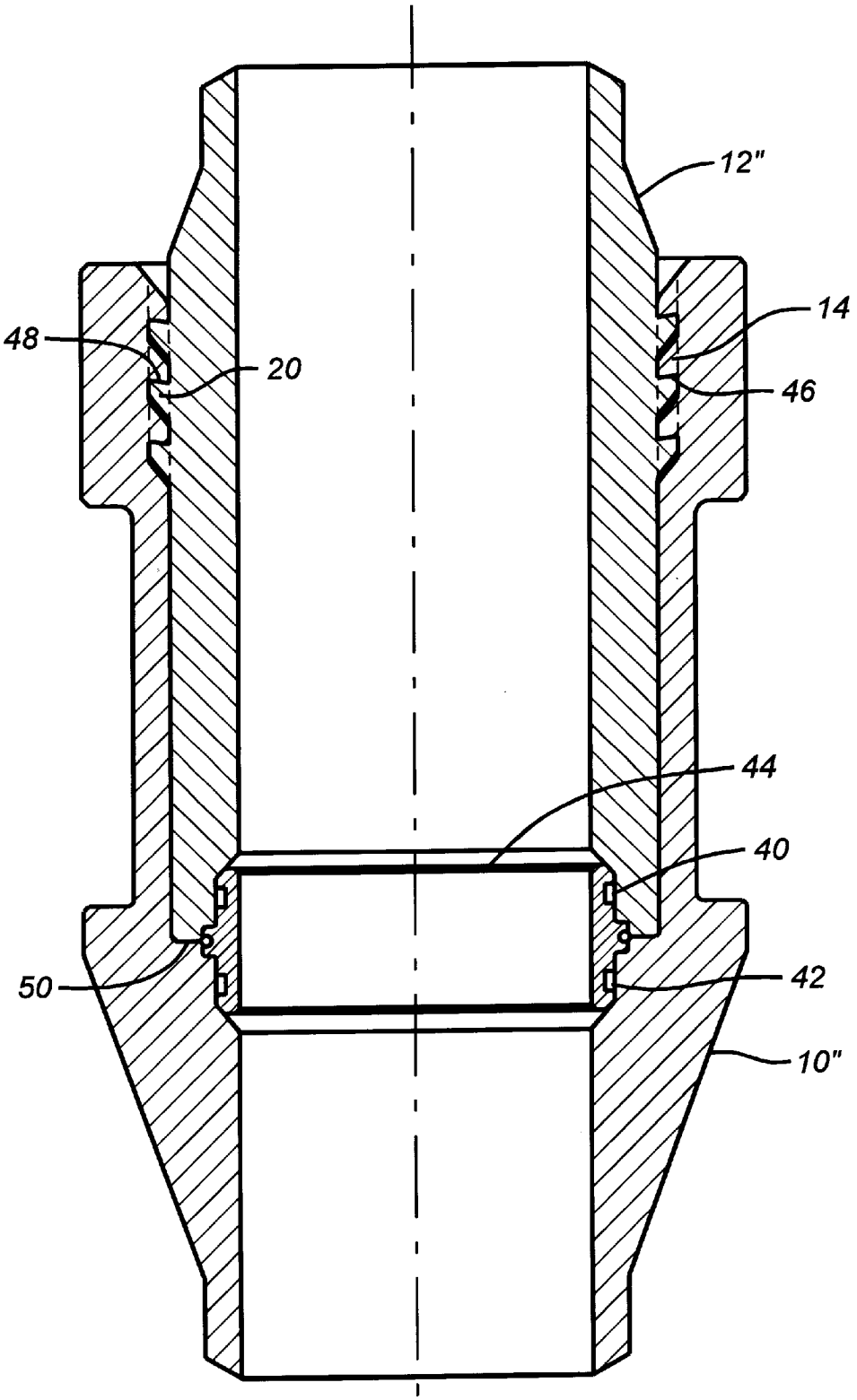
FIG. 11 is an assembled joint using a tensile preload on the box and a compressive preload on the pin with a breech lock, coupled with a seal ring.

While a shoulder 38 coupled with O-rings 40 and 42 have been illustrated as the sealing technique for the joint described in FIGS. 7–10, those skilled in the art will appreciate that other types of seals can be employed in the joint between the pin 12" and the box 10" without departing from the spirit of the invention. The seal and the joint can be a simple metal-to-metal seal with an elimination of the O-rings 40 and 42. As shown in FIG. 11, a seal ring 44, which has a separate structure from the pin 12" or box 10", can be employed. This seal ring 44 can include O-rings such as 40 and 42.

Figure 2:
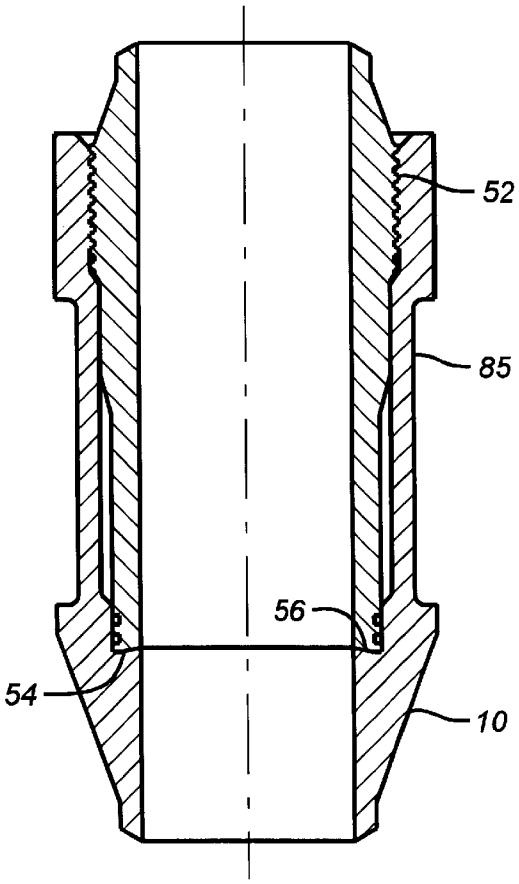
FIG. 2 is an alternative to FIG. 1 using threads.

Another feature of the projections 14 and 20 is best seen in FIG. 11. The projections 14 have a sloping lower surface 46 which, when the spider 32 is released, bears down on a mating sloping surface 48 on projections 20. In the view of FIG. 11, the joint is fully made up and the respective sloping surfaces 46 bear down on opposing surfaces 48 of projections 20 to force the pin 12 against a shoulder 50 shown in FIG. 11. Again, the nature of the sealing connection between the pin 12" and the box 10" is not limited specifically to the illustrated designs but can incorporate a number of variations known to those of skill in the art. Similarly, the locking feature of the connection between the pin 12" and the box 10" can be varied. A threaded connection 52 can be made up while the box 10" is stretched by the spider 32. The thread type of lock is shown in FIG. 2. With thread 52 made up while the box 10 is in a stretched condition where it has yielded elastically, a release of the spider 32 results in shouldering of a lower end 54 on reverse shoulder 56, thus holding a preload in the made-up joint shown in FIG. 2 because the box 10 is not allowed to go back to its original dimension at the time lower end 54 shoulders on reverse shoulder 56.

Figure 3:
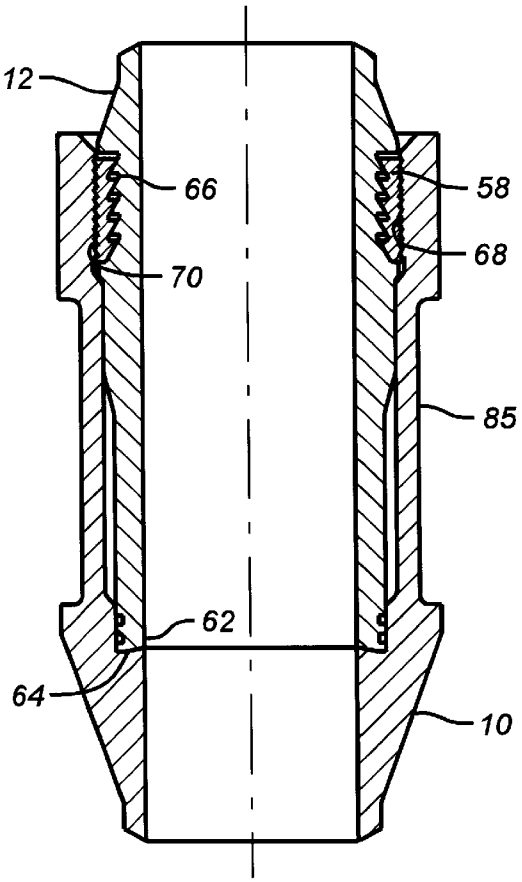
FIG. 3 is an alternative to FIG. 1 using lock rings.

Yet another alternative is shown in FIG. 3. This type of a ratcheting latch is frequently used in downhole tools, especially packers and bridge plugs. It involves the use of a lock ring 58 which loosely fits on a serrated pattern 66 on the pin 12. The box 10 has a serrated pattern 68 which engages a serrated pattern 70 on the lock ring 58. As a result, the loose-fitting lock ring 58 allows advancement of the pin 12 into the box 10, but does not allow withdrawal by a longitudinal force. Instead, the joint reflected in FIG. 3 can be undone by rotation since the serrated surfaces 68 and 70 define a thread pattern which allows disconnection by relative rotation. In the connection of FIG. 3, the box 10 is stretched using spider 32. While the box 10 is elastically deformed, the pin 12 is fully inserted until the lower end 62 shoulders against reverse shoulder 64. At that time, the spider 32 is released, leaving a residual stress in the connection between the pin 12 and the box 10 through the lock ring 58. Those skilled in the art will appreciate that other types of components can be used to accomplish the locking feature without departing from the spirit of the invention. The locking mechanisms described in FIGS. 1–3 involve relative rotation for release. The FIG. 3 design allows locking without relative rotation, while the FIGS. 1 and 2 design require relative rotation for make-up.

Those skilled in the art will appreciate that the spider 32 is also employed for release so that the box 10 is restretched before relative rotation of the parts is attempted to facilitate rapid undoing of the connection.

Figure 14:
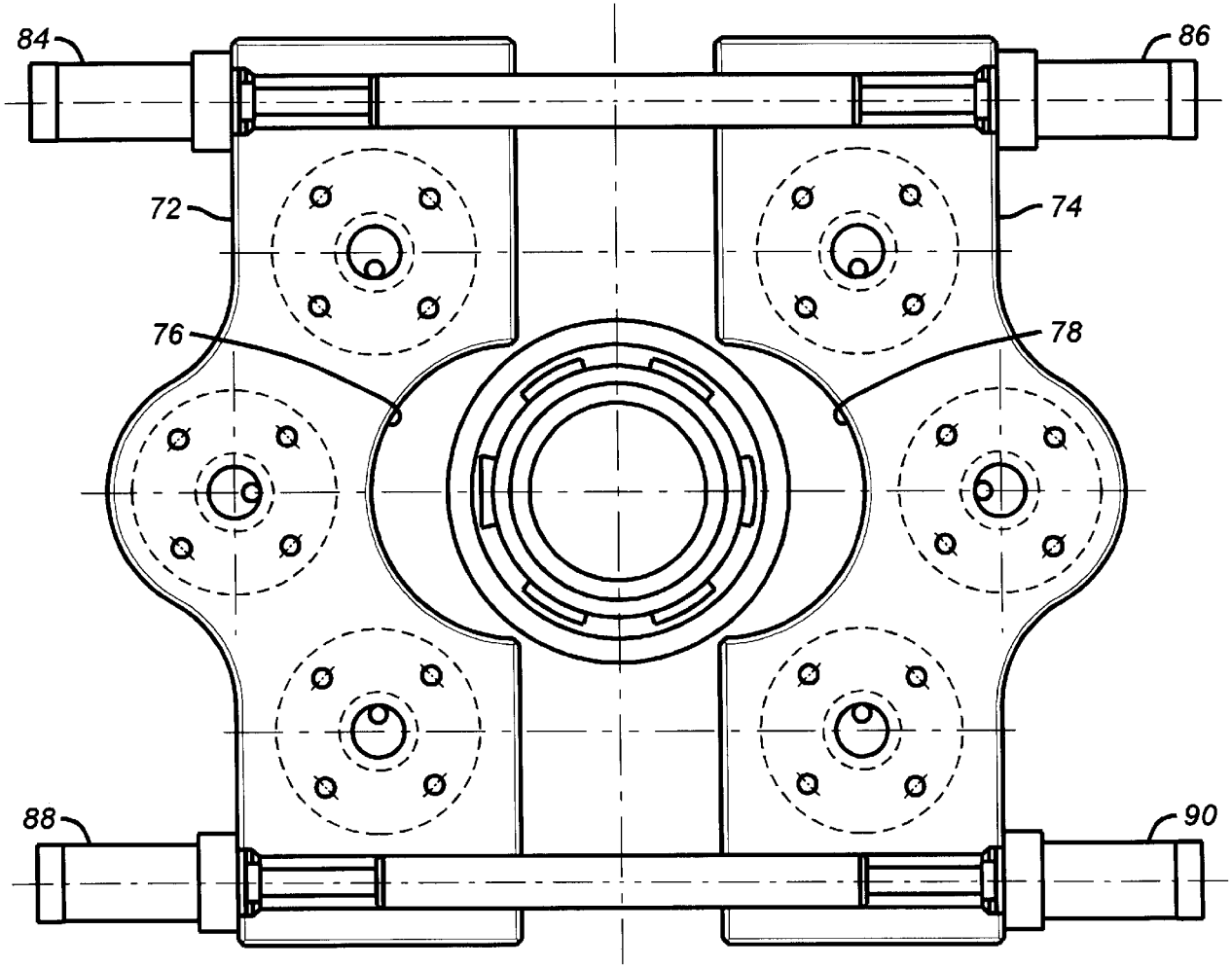
FIG. 14 is a plan view of the spider in the open position.
Figure 15:
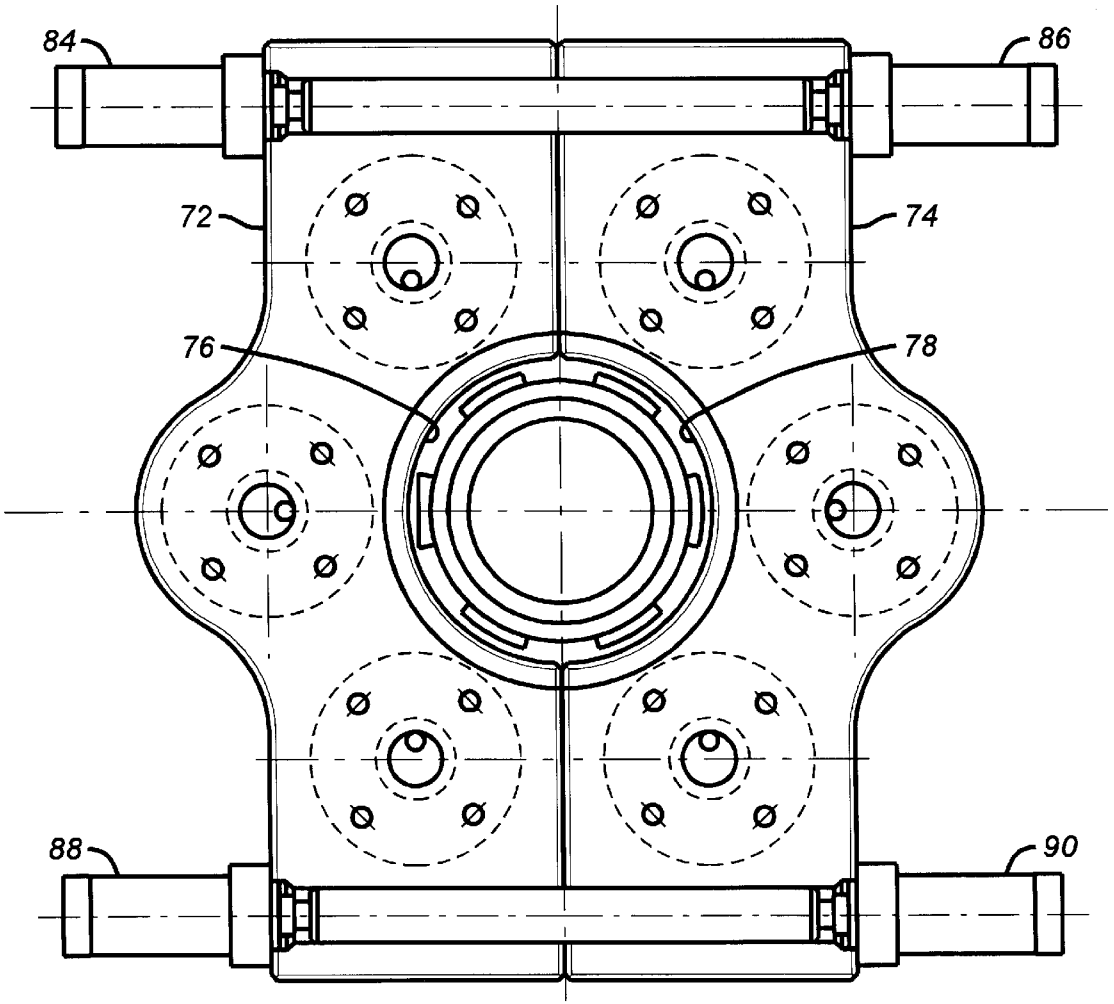
FIG. 15 is the view of FIG. 14 with the spider in the closed position.

FIGS. 12–14 further describe the constituent features of the spider 32. As best seen in FIGS. 12 and 14, the spider 32 includes upper plates 72 and 74 which, respectively, have an arcuate cutout 76 and 78. The cutouts in all the plates can be of a fixed dimension, as shown, or they can be of a variable dimension operating in an iris fashion to accommodate a range of pipe sizes working on a principle, for example as used in known variable bore rams. Below plates 72 and 74 are opposing lower plates 80 and 82 which have similar cutouts in them such as shown for plates 72 and 74 in FIG. 14. The radius of the cutouts 76 and 78 is designed to closely approximate the diameter of groove 85 (see FIGS. 1–3). As a result, upper plates 72 and 74 contact shoulder 34 when the spider 32 is actuated to first bring them together and thereafter to separate them from plates 80 and 82. The lower plates 80 and 82 contact shoulder 36 when the spider 32 is actuated to bring them together and to separate them from plates 72 and 74. The plates 72, 74, 80 and 82 are actuated hydraulically from the position shown in FIG. 14 to the position shown in FIG. 15, using hydraulic cylinders 84, 86, 88 and 90 which, in FIG. 14, illustrate how the top plates 72 and 74 can be brought together or pushed apart.

Figure 6:
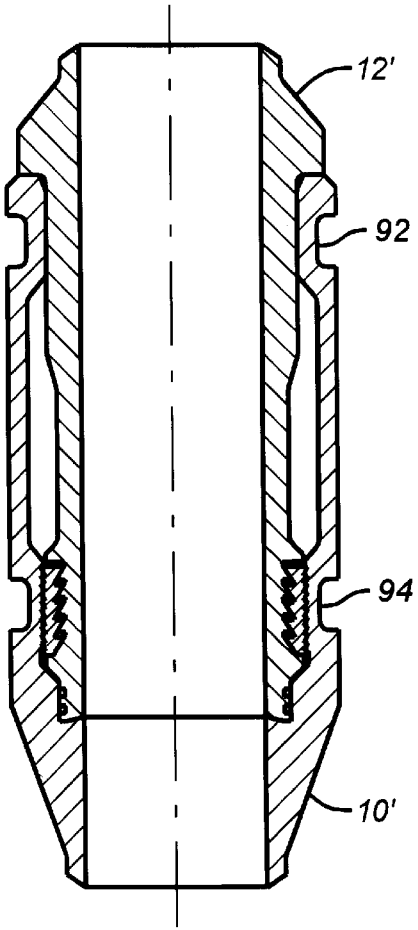
FIG. 6 is an alternative to FIG. 4, using lock rings.
Figure 5:
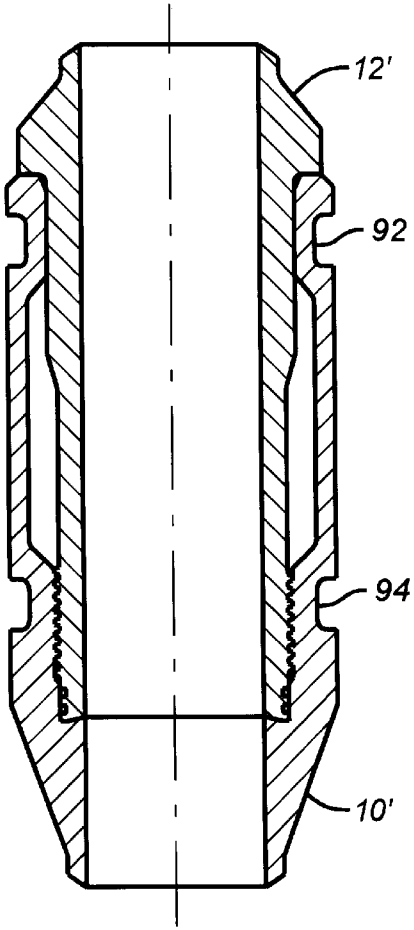
FIG. 5 is an alternative to FIG. 4, using threads.
Figure 4:
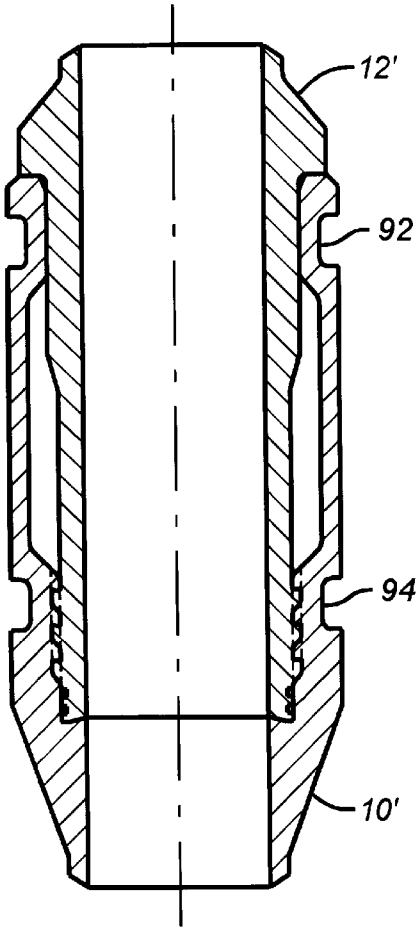
FIG. 4 is a joint of the present invention which obtains a preload through compression on the box and tension on the pin, using a breech lock to lock the joint.

The external hydraulic system is one known in the art and is, therefore, not illustrated in the figures. The spider 32 can be used with the configuration shown in FIGS. 4–6 by allowing the upper plates 72 and 74 to engage groove 92, with lower plates 80 and 82 engaging groove 94. The operation to place a compressive load on the embodiment of FIGS. 4–6 is simply the reverse of placing a tensile load on the box 10 shown in FIGS. 1–3. FIGS. 4–6 illustrate a slightly reconfigured box 10' which in all other ways is similar to box 10 shown in FIGS. 1–3 except that two separated grooves 92 and 94 are disclosed. Other than that, the three embodiments shown in FIGS. 4–6, respectively, are identical to those shown in FIGS. 1–3. The only difference is that the box 10' in FIGS. 4–6 is placed in compression as the pin 12' is inserted and secured within the box 10'. Thereafter, the plates are moved apart vertically and then horizontally, allowing the spider 32 to be retracted and allowing the distance to increase between grooves 92 and 94 to put a residual stress on the lock arrangement, regardless of whether a breech lock is used as indicated in FIG. 4, a thread in FIG. 5, or a lock ring arrangement shown in FIG. 6. Again, the objective is to retain a residual compressive stress in the box 10' when the spider 32 releases from grooves 92 and 94. Yet another way to obtain the desired preload in the assembled box and pin is to either heat the pin (FIGS. 4–6) or cool the pin (FIGS. 1–3) while the pin is assembled to the box 12.

Referring to FIGS. 12 and 13, the hydraulic cylinders such as 96 and 98 are illustrated as those devices which are capable of bringing the upper plates 72 and 74 closer to or further away from lower plates 80 and 82 to facilitate the application of a tensile or compressive force to the box 10 or 10', as described above. The sequence of operation in assembling a riser system using the spider 32 and the connections of the type illustrated, for example, in FIGS. 1–6 is as follows: A segment of the riser, which includes the box 10 or 10', is suspended on the rig floor. The spider 32 is then used to retain the box 10 in groove 85 or, alternatively, if using the box 10' in grooves 92 and 94. In the case of the box 10, the weight of the assembled riser acts to assist in putting a tensile force onto box 10. To the extent a seal ring 44 is used, it is installed into the box 10 or 10'. The spider 32 is then operated to, in the case of FIGS. 1–3, stretch the box 10 elastically. The next joint in the riser is lifted on the rig floor with the pin end down for stabbing into the box 10 or 10'. Depending on their configuration, rotation of the upper riser joint may be required to engage the locking mechanism, such as, for example, using the breech lock or threaded alternative shown in FIGS. 1 and 2. The spider 32 is then released, allowing the box 10 to contract, in the embodiment shown in FIGS. 1–3, using an applied tensile force; or to expand, using the configuration shown in FIGS. 4–6, which applies an initial compressive force.

The materials of the pin 12 or box 10 do not need to be identical. In fact, advantages in operation can be obtained with dissimilar materials. In one example, which is preferred, the box 10 can be made of a titanium alloy and the pin can be made of a nickel alloy or vise versa in another embodiment. Titanium alloy is selected for its high strength, corrosion resistance, and fatigue resistance, as well as its light weight and low modulus and elastic characteristics. Nickel alloys are utilized for high strength, corrosion resistance, fatigue resistance, and a high modulus and rigidity characteristics. These two materials are also selected because they will resist corrosion, particularly when the joints are subjected to subsea uses. The low modulus of the titanium alloys facilitates elastic deformation of the box 10 using the spider 32. By virtue of the fact that the pin 12 has a higher modulus and rigidity characteristics, the desired effect of prestressing the joint is achieved in that the release of the box 10 from the spider 32 in, for example, the embodiment of FIG. 1, allows the preload to be applied by the box to the pin since the box has a lower modulus and is, therefore, more elastic. The pin 12, which is more rigid, is not in itself elastically compressed as much as the box upon release of the box 10. Rather, since the pin 12 is more rigid, the shrinkage of the box 10 simply results in an applied preload to the pin 12, as opposed to a dissipation of the available preload force by elastic compression of pin 12 by the contracting box 10. The effective creation of preload is the desirable objective of the joint. While the preferred combination has been revealed, other combinations of materials, which will enhance the applied preload to the completed joint, are also within the scope of the invention.

The foregoing disclosure and description of the invention are illustrative and explanatory thereof, and various changes in the size, shape and materials, as well as in the details of the illustrated construction, may be made without departing from the spirit of the invention.

What is claimed:

1. A tubular joint, comprising:

a box having a longitudinal axis a pin having a radial projection a longitudinal axis and insertable into said box a lock acting on said pin and said box to hold said pin and box together said lock operative to hold said pin and box together under a residual strain resulting from making up said pin to said box to engage said lock at a time when one of said pin or said box is elastically longitudinally strained followed by allowing, at least in part, a reversal of said longitudinal strain.

2. The joint of claim 1, wherein:

said lock is operative internally between said pin and said box.

3. The joint of claim 2, wherein:

said lock is actuated by relative rotation between said box and said pin upon insertion of said pin into said box and releasing said elastic strain.

4. The joint of claim 3, wherein:

said box is configured to be placed in tension as said pin is inserted and said lock is engaged.

5. The joint of claim 4, wherein:

said box comprises opposed shoulders which are moved away from each other to produce a tensile strain in said box as said pin is assembled to it and said lock is engaged.

6. The joint of claim 5, wherein:

said pin and said box have different moduli of elasticity.

7. The joint of claim 4, wherein:

said pin seals into said box by metal to metal contact.

8. The joint of claim 4, further comprising:

a resilient seal between said pin and said box.

9. The joint of claim 8, wherein:

said resilient seal is mounted to a ring fitting between said pin and said box.

10. The joint of claim 4, wherein:

said box further comprises a stop shoulder to engage an end of said pin after said lock is engaged and said tension on said box is reduced.

11. The joint of claim 4, wherein:

said pin further comprise a stop shoulder to engage an end of said box after said lock is engaged and said compression of said box is reduced.

12. The joint of claim 1, wherein:

said box is configured to be placed in tension as said pin is inserted and said lock is engaged.

13. The joint of claim 12, wherein:

said box comprises opposed shoulders which are moved away from each other to produce a tensile strain in said box as said pin is assembled to said box and said lock is engaged.

14. The joint of claim 1, wherein:

said box is configured to be placed in compression as said pin is inserted and said lock is engaged.

15. The joint of claim 14, wherein:

said box comprises opposed shoulders which are moved toward each other to produce a compressive stress in said box as said pin is assembled to said box and said lock is engaged.

16. The joint of claim 1, wherein:

said pin is elastically expanded prior to assembly to said box.

17. The joint of claim 1, wherein:

said pin is elastically contracted prior to assembly to said box.

18. The joint of claim 1 wherein:

said pin and said box are made of different materials.

19. The joint of claim 18, wherein:

said pin comprises a titanium alloy and said box comprises a nickel alloy.

20. The joint of claim 1, wherein:

said pin and said box have different moduli of elasticity.

21. A tubular joint, comprising:

a box having a longitudinal axis a pin having a radial projection a longitudinal axis and insertable into said box a lock acting on said pin and said box to hold said pin and box together a device mounted to at least one of said pin and said box to apply a longitudinal strain to one of said pin or said box prior to engagement of said lock;

said lock operative to hold said pin and box together under a residual strain resulting from making up said pin to said box to engage said lock at a time when one of said pin or said box is elastically longitudinally strained by said device followed by allowing, at least in part, a reversal of said longitudinal strain applied by said device.

* * * * *